US006176593B1

(12) United States Patent
Spitler et al.

(10) Patent No.: US 6,176,593 B1
(45) Date of Patent: Jan. 23, 2001

(54) UTILITY BOX WORKLIGHT

(75) Inventors: Brian L. Spitler, Elon College, NC (US); Pei Sheng Qian, Shanghai (CN); M. Gary Grossman, Riverside, CT (US)

(73) Assignee: Regent Lighting Corporation, Burlington, NC (US)

( * ) Notice: Under 35 U.S.C. 154(b), the term of this patent shall be extended for 0 days.

(21) Appl. No.: 09/320,406

(22) Filed: May 26, 1999

Related U.S. Application Data

(60) Provisional application No. 60/086,762, filed on May 26, 1998.

(51) Int. Cl.[7] ..... F21L 4/04

(52) U.S. Cl. ..... 362/199; 362/154; 362/186

(58) Field of Search ..... 362/154, 156, 362/186, 190, 199, 376, 427

(56) References Cited

U.S. PATENT DOCUMENTS 4,544,994 * 10/1985 Steeves, Jr. ..... 362/199 X
5,779,350 * 7/1998 Chang ..... 362/154

* cited by examiner

*Primary Examiner*—Stephen Husar
(74) *Attorney, Agent, or Firm*—Niro, Scavone, Haller & Niro

(57) ABSTRACT

A portable worklight having a protective outer casing which encloses the contents of the light. The outer casing includes first and second housings which are operable between open and closed positions. When in a closed position, the working components of the light, including the lens, grill, and light source are enclosed by the two housings. In an open position, the second housing acts as a base which holds the worklight in an upright position.

1 Claim, 1 Drawing Sheet

10
12
13
14
16
18
19
20
21
22
24
26
28
30
32
33
34
36
37
38
39
40
61
63
6

UTILITY BOX WORKLIGHT

This application claims priority to U.S. Provisional Application Ser. No. 60/086,762 filed May 26, 1998.

BACKGROUND OF THE INVENTION

The invention relates to portable worklights, and more specifically, a portable worklight that includes an outer protective housing.

SUMMARY OF THE INVENTION

Typical worklights consist of a light housing which typically contain the components necessary to illuminate an object. This would include, among other things, a lens, grill, light source or lamp, and the necessary wiring and electrical components. In addition, a tubular support stand often is used to support the light housing in an upright position. However, because the worklights are intended to be portable, the worklights are often transported in vehicles and the like along with other equipment. As a result, the worklight is susceptible to damage when being transported, especially the light source and lens which mare made of glass and remain exposed to damage from foreign objects. In addition, while the common support stand is useful when the light is in a stationary position, in a moving vehicle it typically fails to support the device in a stable condition.

The present invention minimizes the risk of damage during transportation by providing a worklight having opposing first and second housings which enclose the worklight when in a closed position and which hinge open for use. Moreover, the housings have at least one flat surface that supports the light housing in an upright position during use and in a stable position when being stored and/or transported.

Consequently, an object of the present invention is to provide a worklight which incorporates a protective housing as part of the light.

Another object of the present invention is to provide a first housing that contains the light source and an opposing second housing that acts as base.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

Figures 1, 2, 3, 4, 5, 6, 7:
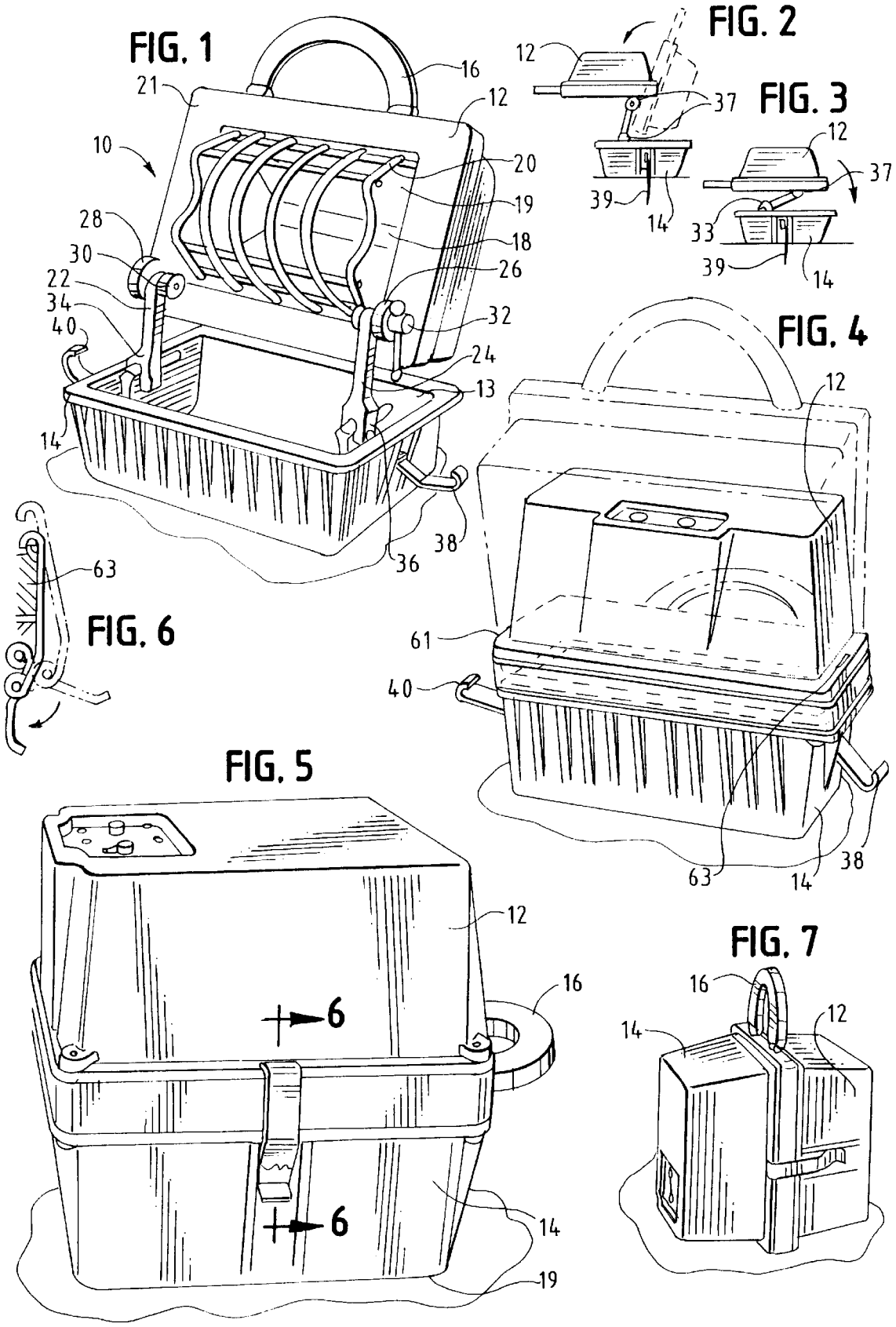
FIG. 1 is a perspective view of one embodiment of the present invention.
FIG. 2 is a side view of the embodiment shown in FIG. 1 partially open.
FIG. 3 is a side view of the embodiment shown in FIG. 1 prior to being placed into a closed position.
FIG. 4 is a perspective view of the embodiment shown in FIG. 1 in a closed position.
FIG. 5 is a perspective view showing the latch in a closed position.
FIG. 6 is a side view of the latch taken along line 6—6.
FIG. 7 is a perspective view of an alternate embodiment of the present invention.

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

FIG. 1 shows a worklight 10 having a first housing 12 and second housing 14 both of which define a cavity. Located in the cavity of housing 12 are the components making up a standard light, i.e., a lens 17, light source 18, grill 20, and front plate 21 as well as the necessary wiring and electrical components (not shown)among other things.

The housings are connected together by hinges 22 and 24 as shown in FIG. 1 or hinge 100 as shown in FIG. 7. As shown in FIGS. 2 and 3, hinges 22 and 24 form two pivot points 33 and 37 with housings 12 and 14.

Spring latches 38 and 40 coact with edges 61 and 63 to releasably secure the housings together. Hinges 22 and 24 include latches 34 and 36 which releasably secure the hinges in a stationary position during operation of the light source and permit the rotation of the hinges when released. Coacting fasteners 30 and 32 pivotally connect housing 12 to hinges 22 and 24 as well.

In use, worklight 10 is stored and transported in a closed position as shown in FIG. 5. In this position, the grill, light source, and lens are all enclosed by the housings and are inaccessible to foreign objects which would damage the components. In addition, the flat surface 19 of housing 14 holds the device in a stable position which further minimizes the risk of damage to the device. When the light is needed to illuminate an object, latches 30 and 40 are operated to release the housings which allows housing 12 to pivot about pivot point 33. This allows housing 12 to move forward as well as up and away from housing 14 and into a position located above the central portion of housing 14 until latches 38 and 40 catch and hold hinges 22 and 24 in a stable, extended position. This, in turn, raises the grill and other operating components of the light out of the cavity formed by housing 14. Next, housing 12 is pivoted about fasteners 30 and 32 until a desired position of illumination is obtained. At the same time, housing 14 functions as a base to hold the light source in an upright position.

Moreover, placing pivot points 33 and 37 offset from the center line 39, as shown in FIGS. 2 and 3, permits housing 12 to remain centrally located with respect to housing 14. This maintains the balance of the device when it is in an open position which helps prevent tipping. It also allows the components in housing 12 to nest within housing 14. Because the components must be centrally aligned to nest within housing 14, as shown in FIGS. 2 and 3, to close the device, pivot point 37 which is located on the lower end of housing 37, is positioned to coordinate with the length of the hinges to place the outer of edges of the two housing together when in a closed position.

In an alternate embodiment, a single pivot point is used to connect housing 102 to 104. The construction and operation of this embodiment is similar to the embodiment described above.

It should be understood that various changes and modifications to the preferred embodiments described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A portable worklight comprising:

first and second housings, said housings pivotal between open and closed positions;

a lens, light source, and grill located on said first housing;

in said closed position, said lens, grill, and light source are enclosed by said housings; and in said open position, said second housing acts as a base which holds said worklight in an upright position.

* * * * *